United States Patent [19]

Morgan

[11] 3,941,510

[45] Mar. 2, 1976

[54] ARTIFICIAL LIFT FOR OIL WELLS

[76] Inventor: Thomas H. Morgan, Suite 528 800 NW. Loop 410, San Antonio, Tex. 78216

[22] Filed: Apr. 14, 1975

[21] Appl. No.: 567,989

Related U.S. Application Data

[62] Division of Ser. No. 496,173, Aug. 9, 1974, Pat. No. 3,894,583.

[52] U.S. Cl. ..... 417/57; 417/58; 417/86; 417/392; 166/68; 166/106

[51] Int. Cl.[2] F04B 47/12; F04B 23/14; F04B 35/00

[58] Field of Search ..... 417/56, 57, 58, 59, 86, 417/392; 166/67, 68, 106

[56] References Cited

UNITED STATES PATENTS

| | | | |
|---|---|---|---|
| 2,391,542 | 12/1945 | Benard | 417/86 |
| 2,704,980 | 3/1955 | Vincent | 417/59 |
| 3,302,581 | 2/1967 | Burch | 417/59 X |
| 3,797,968 | 3/1974 | Blfarr | 417/145 X |

*Primary Examiner*—Carlton R. Croyle
*Assistant Examiner*—Richard E. Gluck
*Attorney, Agent, or Firm*—Cox, Smith, Smith, Hale & Guenther Incorporated

[57] ABSTRACT

An apparatus for retrieving oil from a producing zone after the bottom hole pressure has decreased to such an extent that artificial lift is required for production. An accumulator is provided by casing sealed off with a packer, or an accumulation chamber located in the area of the casing where oil accumulates. The uppermost portion of the accumulator is vented to atmosphere to allow oil flow therein. A floating piston-type device may be located immediately above the accumulator with a bypass from the accumulator to the top of the floating piston. Pressure is subsequently applied through the vent line to the accumulator to force oil from the accumulator through a stinger tube above the floating piston and subsequently raise the oil and floating piston to the surface. Without the piston, a stinger tube and standing valve may be used to accumulate oil in the production tubing. The vent line may be located inside the production line with the upper casing being used as a pressure storage tank.

6 Claims, 3 Drawing Figures

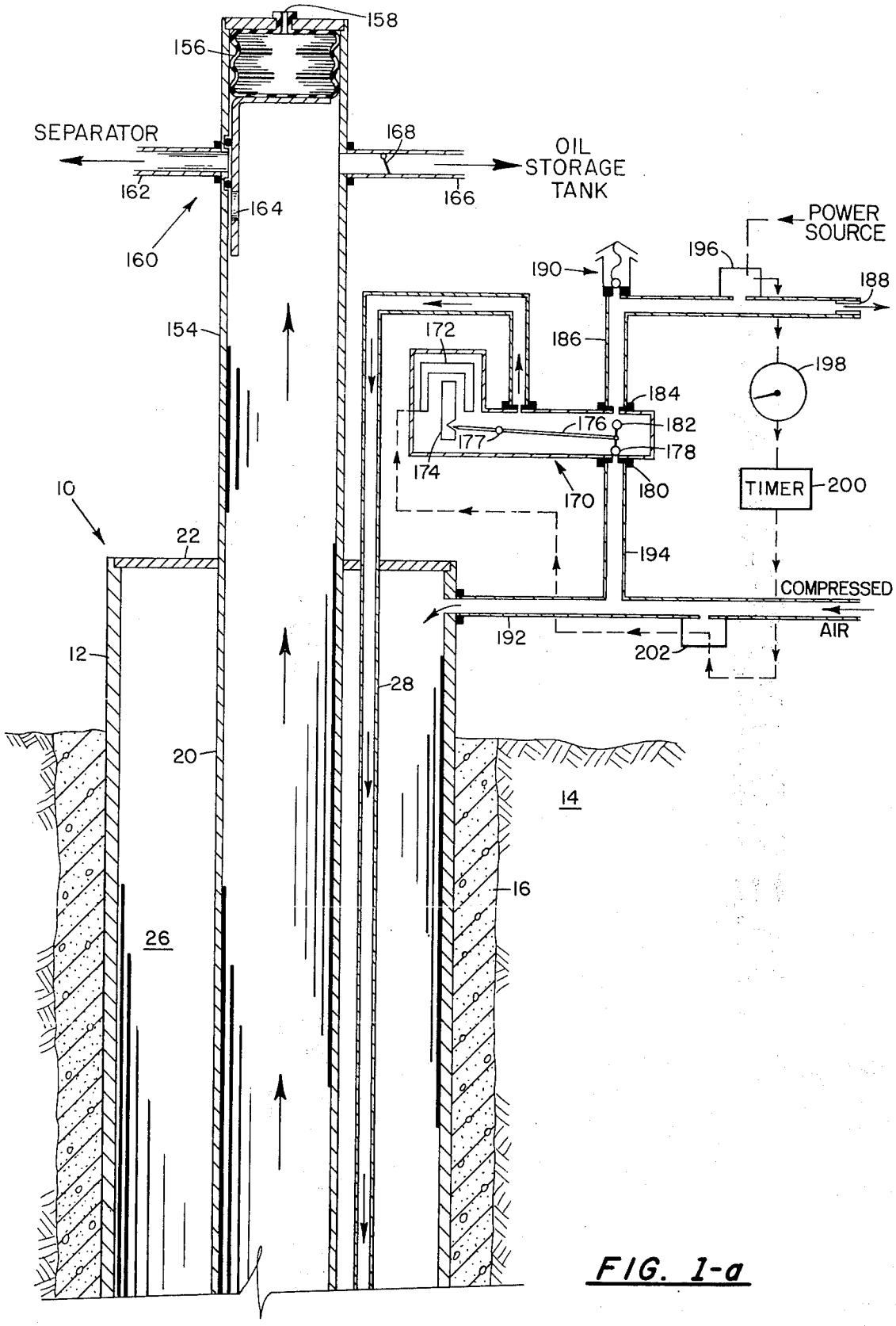
FIG. 1-a

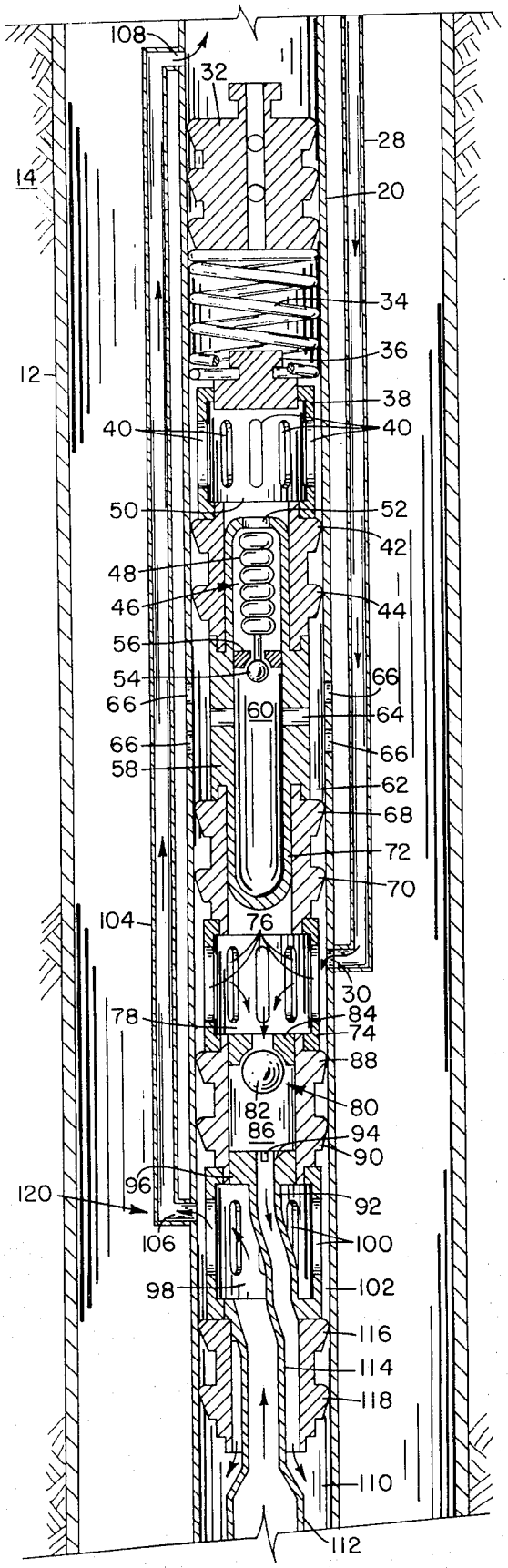
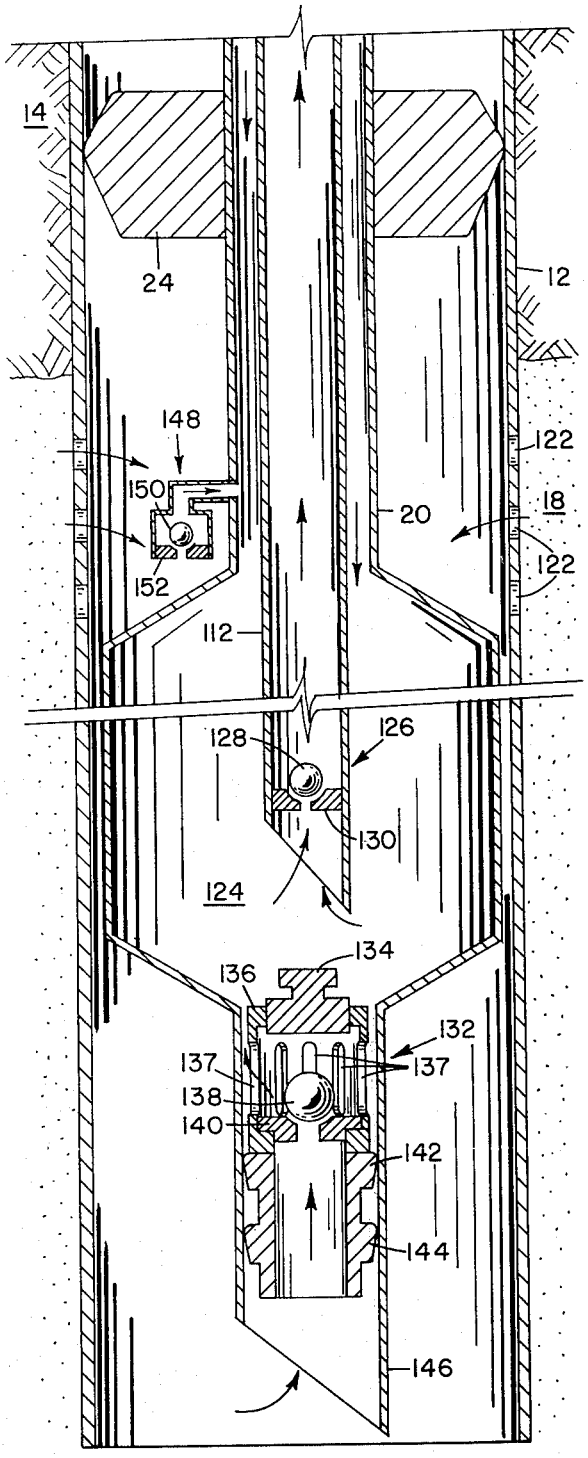
FIG. 1-b

ARTIFICIAL LIFT FOR OIL WELLS

This is a division of application Ser. No. 496,173, filed Aug. 9, 1974, now U.S. Pat. No. 3,894,583.

BACKGROUND OF THE INVENTION

This invention relates to oil recovery devices and, more specifically, to an artificial lift for recovering oil from wells that do not have sufficient bottom hole pressure to raise the oil to the surface. The apparatus includes an accumulator to receive the oil in the casing and a vent line to the surface which may subsequently be pressurized to raise the oil contained in the accumulator into the production tubing and, subsequently, to the well head. The upper casing may be pressurized for gas lift of a piston type device (or plunger), or used as a pressure storage tank.

DESCRIPTION OF THE PRIOR ART

This invention is an improvement over U.S. patent application Ser. No. 476,212 filed on June 4, 1974 and having the same inventor as the present application.

There are several stages in the productive life of an oil well that should be reviewed before going into the details of the present invention. When a hydrocarbon producing well (oil well) is drilled, the initial stage of production normally does not require any type of lift mechanism to raise the oil from the producing formation to the well head. The pressure on the oil itself is normally sufficient to raise the petroleum (gas and oil) to the well head. As oil is produced from the oil reservoir, the bottom hole pressure will continue to drop until it reaches a point where the bottom hole pressure is no longer sufficient to raise the column of oil to the well head.

Once the bottom hole pressure has reduced to such an extent that it will no longer raise the column of oil to the well head, steps can be taken to reduce the weight of the column. A column of fluid from the oil reservoir to the well head that does not contain gas weighs more than a column that does contain gas. Therefore, a system called gas lift and commonly used by the petroleum industry is to bubble gas up through the column of oil thereby reducing the weight of the column and causing the oil from the well to continue to flow. Now the bottom hole pressure is sufficient to raise the lightened column to the well head for a normal production flow. This continues until the bottom hole pressure is again reduced to a greater degree so that it is no longer sufficient to raise the lightened column to the surface of the well.

The next stage in the productive life of an oil well under present day operating conditions would be to allow the oil to accumulate in the tubing and then to pressurize the casing. By having a gas lift valve below the oil accumulated in the tubing, a blob of oil could be raised to the surface. Thereafter, the pressure on the casing would be relieved and oil would be allowed to accumulate again in the tubing. This process is repeated again and again by allowing oil to accumulate in the tubing, pressurizing the casing and raising the blob of oil to the well head and relieving the pressure to allow oil to accumulate again in the tubing. This process has been aided somewhat by the use of swabs or subsurface plungers (commonly called free floating pistons) with the swabs or plungers allowing the oil to accumulate above their location in the production tubing. Thereafter, further pressure increases in the casing would raise both the oil and the swab or plunger to the surface. Subsequently, the swab or plunger would be allowed to fall back to its original position in the tubing and the cycle repeated.

Because the casing, which is alternately pressurized and depressurized, can only stand a certain amount of pressure, even the type of gas lift just described has limited application. At this stage of the productive life of the well, some type of subsurface pump is needed to raise oil to the surface of the well. Bottom hole pumps are very expensive, wear out and must be replaced periodically. It becomes a matter of economics as to when the bottom hole pressure is no longer sufficient to discharge enough oil from the well to justify the cost of maintaining the costly well equipment. At this point in time, the well is usually abandoned unless other drastic steps such as flooding the production zone are used. At this particular point the bottom hole pressure has dropped to substantially zero.

Some production has occurred in old petroleum fields by drilling holes below the productive zone. Actions such as latent water drives, formation compression, gravity and many other contributing factors may cause oil to gradually fill the holes drilled below the productive zone. However, to remove the oil that has accumulated in the hole drilled below the productive zone (commonly called sump bores) is very costly, again requiring some type of subsurface pump to raise the oil to the surface of the well. Such production is normally economically unfeasible.

It should be noted in the previously described gas lift systems that a gas source may be necessary. Because all the gas cannot be recovered, gas lift systems are costly to run because the gas lost is the same as lost income, or operating costs. Atmosphere could not be used because mixing of atmosphere and oil will cause an emulsion that is very detrimental to the oil produced.

SUMMARY OF THE INVENTION

The present invention is directed towards an economical means and apparatus for continuing production of an oil well after it becomes economically unfeasible using normal production techniques. An accumulator is positioned in the oil that naturally drains into the oil well. A vent line allows the accumulator to be at the same pressure as atmosphere so that the oil will fill the accumulator. Thereafter, the accumulator is pressurized through the vent line, forcing the oil through a standing valve and stinger tube into the production tubing. The vent line is located inside the production tubing with a crossover device being provided above the accumulator. Packers seal off the upper casing which can be used as a storage tank. Packers also may seal off a sump area of the lower casing to be used as the accumulation chamber.

In the embodiment using a floating piston or swab, a bypass line moves the oil above the free floating piston or swab. By using a crossover type device and packer, the upper casing may be pressurized. As the pressure of the column of oil increases, a differential pressure valve will operate allowing the pressurized air in the upper casing to rapidly move the piston to the well head. The oil accumulated above the piston will also rise to the surface of the well. Once the piston has reached the top of the well and pressure in the production tubing is vented, the piston is allowed to fall back into its position above the accumulator. As oil again collects in the accumulator, the previously mentioned cycle is repeated.

A ball float valve in the air line tells an electronic control circuit through an associated pressure switch when the accumulator has been filled; therefore, it is time to pressurize the accumulator and raise the oil to the surface. An appropriate clock mechanism is used to time the cycle to control the compressed air in and out of the accumulator.

In another embodiment, the stinger tube simply feeds through a crossover seal area above the accumulator into the accumulator. The accumulator is a lower sump area sealed off by packers. Upon pressurizing the accumulator, oil moves through the standing valve, stinger tube and crossover into the production tubing. Pressure is then relieved and oil again collects in the accumulator with the standing valve preventing the previous collected oil from feeding back from the production tubing into the accumulator. By alternately venting and pressurizing the accumulator, the oil is moved up the production tubing to the well head. Once the oil has been collected in the accumulator, it is never lost, and once the oil enters the production tubing, it never reenters the accumulator. The upper casing, if strong enough, may be used as an air storage tank.

Therefore, it is an object of the present invention to provide an apparatus for gathering oil from a well once the well has stopped flowing due to a decrease in pressure of the reservoir.

It is a further object of the present invention to provide artificial lift for an oil well that utilizes the minimum of equipment so that is is economically feasible to continue production from an oil well in ranges of approximately 1 barrel per day.

It is still another object of the present invention to position an accumulator in oil that would naturally accumulate in the bottom of the well, vent the top of the accumulator to the atmosphere to allow oil to flow through a check valve into the accumulator. Subsequently, the accumulator is pressurized, thereby forcing oil up through a stinger tube and bypass tube to a position above a free floating piston or swab. A differential gas lift valve will raise the free floating piston or swab with the oil contained thereabove to the well head.

It is yet another object of the present invention to use a ball float valve in the vent line in combination with a pressure switch and choke located at the surface to give a signal indication when the accumulator is full of oil. The signal is then used to trigger control circuitry that would be used to pressurize the accumulator.

It is still another object of the present invention to use a differential gas lift valve underneath the free floating piston or swab so that the pressure differential between the column of oil above the piston and in the upper casing (blocked off from the producing zone by a packer) reaches a given point, the differential gas lift valve will operate and the free floating piston or swab will begin to rise to the surface.

It is yet another object of the present invention to provide a retrievable apparatus to allow direct access to the accumulator and to the bottom of the well.

It is yet another object of the present invention to provide a system that can be used in the production of an oil field wherein each of the wells in the oil field have a low volume output and require some type of artificial lift.

Yet another object of the present invention is to provide an accumulator located in the oil that collects in the casing, the accumulator being alternately vented to the atmosphere to collect oil and pressurized to force the oil through a standing valve in a stinger tube into the production tubing, the oil column in the production tubing continually increasing until it reaches the well head and flows with each cycle.

Even another object of the present invention is to provide an artificial lift mechanism wherein a packer is contained between the casing and the production tubing so that the upper portion of the casing may be used as an air storage tank. A crossover type of device is located near the packer and immediately above the stinger tube so that only one tubing extends through the packer with the other tubing being contained therein. An accumulator chamber may be formed below the producing zone by having another packer located below the oil producing zone with a standing valve allowing the oil to flow into the lower region. A stinger tube would then extend into the lower region which acts as an accumulator so that upon pressurization the oil is forced up through the stinger tube and the crossover device, and the oil may be subsequently raised to the surface of the well.

Another object of the present invention is to use a differential pressure valve in conjunction with the crossover device so that when the pressure differential between the column of oil above the piston and the pressure in the casing decreases below a given point the differential pressure valve will operate thereby forcing the plunger to the surface of the well.

BRIEF DESCRIPTION OF THE DRAWINGS

FIG. 1*a* is an elevated sectional view of the well head portion of the artificial lift apparatus of the present invention and the associated control mechanisms.

FIG. 1*b* is an elevated sectional view of the down-in-the-hole portion of the artificial lift apparatus of the present invention.

DESCRIPTION OF THE PREFERRED EMBODIMENT

Figure 2:
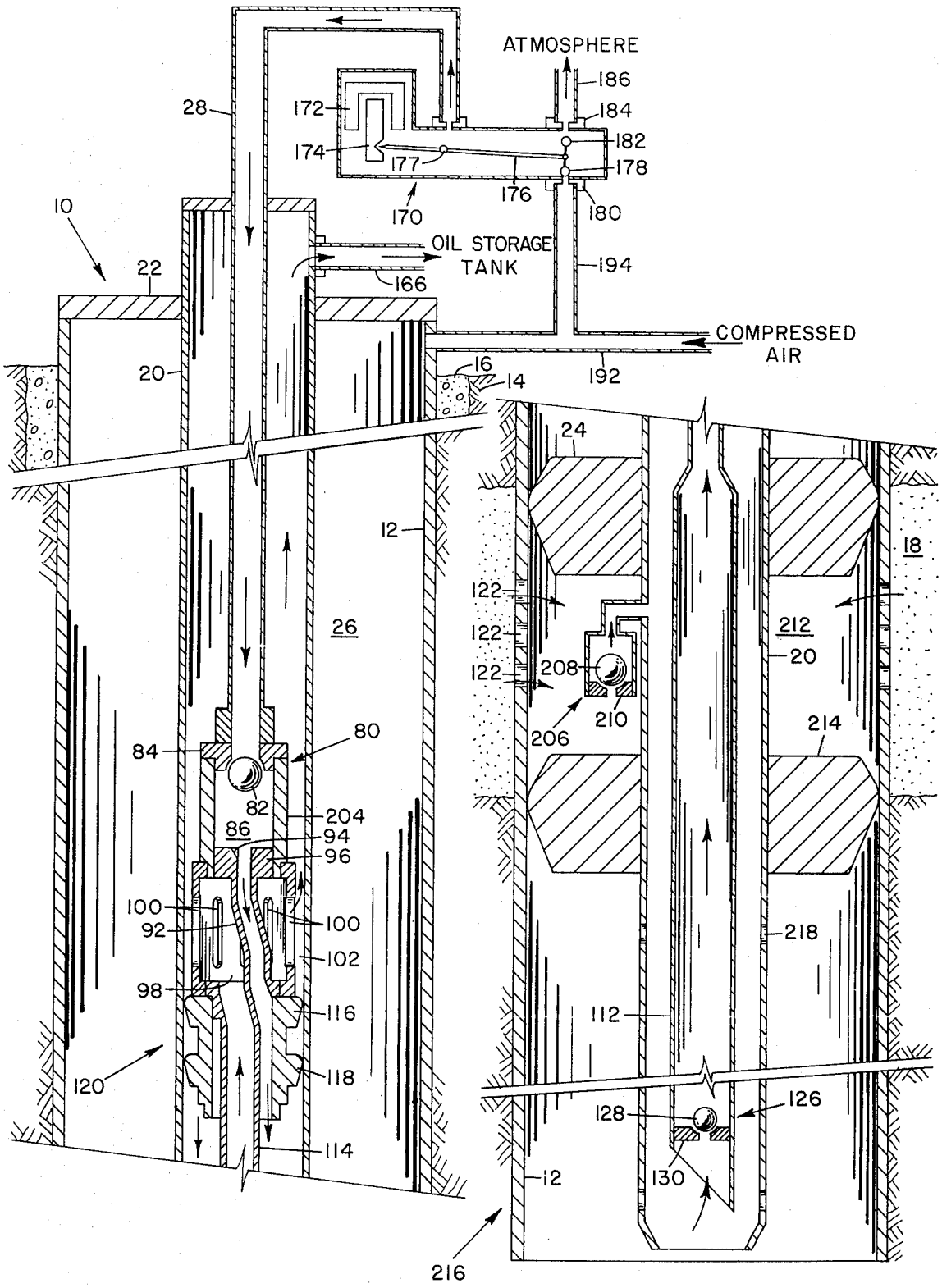
FIG. 2 is an elevated sectional view of an alternative embodiment of the present invention.

Referring now to FIGS. 1*a* and 1*b* in combination, there is shown a hydrocarbon producing well represented generally by the reference numeral 10. Because the present invention is directed towards hydrocarbon producing wells that produce oil, it will hereinafter be referred to as oil well 10. The oil well 10 has the normal casing 12 that extends into the earth formation 14 and is held in place by cement 16 as is the case in most oil wells. The casing 12 extends down into the oil producing zone 18. Inside the casing 12 a production tubing 20 also extends down to the oil producing zone in a manner common in the oil producing industry.

The oil well 10 is the type wherein the well head is sealed by means of plate 22 extending around the production tubing 20 to the casing 12. Located in the earth formation 14 just above the oil producing zone 18 is a packer 24 that again seals the production tubing 20 to the casing 12. Therefore, the space between production tubing 20 and casing 12 from the plate 22 to the packer 24 may be used as a pressure tank and is represented generally by the reference numeral 26. A vent/pressure line 28 extends through the plate 22 and seals therewith. The vent/pressure line 28 also extends down inside the oil well 10 to a point just above packer 24 where the vent/pressure compressor line 28 is connected to the production tubing 20 through opening 30.

In the lower portion of the production tubing 20 immediately above packer 24 is located a plunger 32 that is free floating inside of the production tubing 20. The plunger 32 may be a swab type or a free floating piston commonly referred to as the McMurray piston. The plunger 32 will allow a small amount of flow therethrough, but stop all flow therethrough upon sensing a large pressure differential across plunger 32. Immediately below the plunger 32 is a spring 34 to absorb the shock of the plunger 32 as it falls to its lowermost position, such position being shown in FIG. 1*b*. Immediately below the spring 34 is located a hook 36 that may be used to retrieve apparatus contained in the production tubing 20 as will be subsequently described. The hook 36 is attached to housing 38 having slots 40 contained therein for communication with the space in the production tubing 20 immediately below plunger 32. Attached to housing 38 below slots 40 are hold downs 42 and 44 that rest against seating nipples of the production tubing 20. The seating nipples of the production tubing 20 are not illustrated due to close tolerances, but are commonly used in the oil producing industry. Inside of the hold downs 42 and 44, which form a good seal with the production tubing 20, is located a differential pressure valve 46. The upper portion of the differential pressure valve 46 has a bellows 48 that is in communication with chamber 50 located inside housing 38 by means of hole 52. The valve element 54 normally rests against seat 56. The valve element 54 and seat 56 are contained inside of housing 58 with chamber 60 being in communication with annulus 62 by means of cross bore 64. Annulus 62 is in turn in fluid communication with pressure tank 26 by means of holes 66. Hence the pressure developed across differential pressure valve 46 is the difference between the pressure immediately below the plunger 32 and the pressure inside of casing 12 represented by pressure tank 26. As this differential pressure decreases below a predetermined amount, the differential pressure valve 46 will open as will be subsequently described.

Immediately below the differential pressure valve 46 and housing 58 are located hold downs 68 and 70 that again mate with seating nipples of the production tubing 20. Inside of the hold downs 68 and 70 is located a cap 72 of housing 58 that seals the lowermost portion of chamber 60 so that pressure inside of the production tubing above hold downs 68 and 70 is not reflected below hold downs 68 and 70. Immediately below hold down 70 is a housing 74 having slots 76 but therein so that fluid communications can be transmitted through vent/pressure line 28, opening 30 into chamber 78.

Immediately below chamber 78 is located a float valve 80 which comprises a ball float 82, seat 84 and chamber 86. Chamber 86 is formed by hold downs 88 and 90 that rest against appropriate seating nipples in the production tubing 20. Chamber 86 is always in communication with crossover line 92 due to the slots 94 cut in flange seat 96. The crossover line 92 extends through chamber 98 that has slots 100 cut therein for fluid communication with annulus 102. From annulus 102 a bypass 104 communicates through openings 106 and 108 so that oil contained in chamber 98 may be moved around plunger 32 and other apparatus contained in production tubing 20 via bypass tubing 104 and back into the upper portion of production tubing 20 as will be described in more detail subsequently.

Crossover 92 communicates directly with production tubing 20 and the annulus 110 formed between the production tubing 20 and the stinger tube 112. Chamber 98 communicates with stinger tube 112 via tubing 114 which extends through hold downs 116 and 118 that rest on seating nipples of the production tubing 20. The crossover line 92 and the tubing 114 both extend through the hold downs 116 and 118 to form the crossover portion of the present invention represented generally by the reference numeral 120. The reason for having the crossover portion 120 is because of the packer 24 that isolates the upper internal portion of casing 12 from the lower internal portion so that the upper portion may be pressurized without having any effect on the lower portion that is located in the oil producing zone 18.

The lower portion of the casing 12 has perforations 122 to allow oil from the oil producing zone 18 to flow into the lower part of casing 12. Attached to the bottom of production tubing 12 and in the oil producing zone 18 is located an accumulator 124 that extends some distance along the lower portion of the casing 12. The length of the accumulator 124 could be as much as 100 feet or even more. The stinger tube 112 extends to almost the bottom of accumulator 124 and has a check valve 126 located therein represented generally by a ball 128 and seat 130. In the bottom of the accumulator 124 is a retrievable standing valve 132 having a fishing neck 134, housing 136 with slots 138 cut therein and ball 138 with the mating seat 140. Standing Valve 132 allows flow upward in a manner very similar to a check valve, but not vice-versa. The entire retrievable standing valve 132 is maintained in position by hold downs 142 and 144 with corresponding seating nipples for lower extension 146 of accumulator 124, the lower extension being of approximately the same radius as the production tubing 20 or less. Upon attaching a line to the fishing neck 134 the entire apparatus contained in lower extension 146 may be retrieved to the surface of the oil well 10. Also, immediately above the accumulator 124 and directly below the packer 24 is located a gas vent valve 148 which allows the flow of gas inside of the casing 12 into the production tubing 20 by lifting the ball 150 off of seat 152. The gas vent valve 144 allows for additional venting of gas from the oil producing zone 18 so that the oil and gas may be more readily separated before entry into the accumulator 124.

Referring back to FIG. 1*a*, the upper production casing 154 extends above plate 122 with a pneumatic bellows 156 being located at the top thereof. The pneumatic bellows 156 may be pushed upward and air forced out through hole 158 by the plunger 32 as will be subsequently described. Simultaneously, a sliding valve 160 will be moved upward, thereby establishing communications between tubing 162, hole 164 and the internal portion of production tubing 20. Also, a tubing 166 which has a check valve 168 located therein receives oil from the production tubing 20 and delivers it to the oil tank as will be subsequently described.

The vent/compressor line 28 is connected via a three-way solenoid valve 170 that is operated by means of winding 172 and core 174. The three-way valve 170 has a lever arm 176 that is pivotally connected at pivot point 177. When the winding coil 172 is not energized, the three-way valve 170 will be in the position as shown with ball 178 resting against seat 180. When the winding coil 172 is energized, ball 178 will move away from seat 180 and ball 182 will seal against seat 184.

In the embodiment shown in FIGS. 1*a* and 1*b* vent-/compressor line 28 is in communication through three-way valve 170, conduit 186 through choke 188 to atmosphere. A pop-off valve 190, common in the petroleum producing industry, is also connected to conduit 186 to relieve pressure above a predetermined point in addition to the venting through choke 188.

The casing 12 is connected to a source of pressurized air via conduit 192 which has a branch conduit 194 that extends to the three-way valve 170 and ball 178 and seat 180. The source of pressurized air would normally be a compressor with the casing 12 being the storage tank 26 to provide a large volume of compressed air.

Located in conduit 186 is a pressure switch 196 that is connected to a source of power that may be used to operate the three-way valve 170. The source of power is connected through pressure switch 196 to a clock mechanism 198 and timer 200 to a pressure switch 202 that is responsive to pressure in conduit 192. If the contacts in pressure switch 196 that are responsive to pressure in conduit 186 are closed, and the contacts in pressure switch 202 are closed, the winding coil 172 of three-way valve 170 will be energized for a predetermined period of time as controlled by timer 200.

METHOD OF OPERATION

During the normal operation of the present invention, the storage tank 26 inside of casing 12 will be pressurized by compressed air from a compressor through conduit 192 until pressurized to a predetermined point. During initial pressurization vent/pressure line 28 and production tubing 20 must be blocked at the well head. Once the casing 12 is pressurized to a predetermined point, the blocking of vent/pressure line 28 and production tubing 20 is removed to practice the present invention. Referring now to FIGS. 1*a* and 1*b* in combination, the plunger 32 is located in the position as shown and oil from oil producing zone 18 flows through perforations 122 into the casing 12. The oil in the casing 12 then flows up through standing valve 132 into accumulator 124. Excess gas pressure may enter either through standing valve 132 or gas vent valve 148 into accumulator 124. The gas in accumulator 124 is vented through vent/pressure line 28 via crossover line 92 and float valve 80. Since the vent/pressure line 28 is connected at the well head through three-way valve 170 (as shown) to conduit 186 and choke 188 to atmosphere, the pressure inside of the accumulator is only slightly higher than atmospheric pressure with the difference being controlled by the choke 188. Once the oil from the oil producing zone 18 enters the casing 12 and the accumulator 124 through standing valve 132, it is trapped. As the oil continues to collect in accumulator 124, it will fill the accumulator 124 and begin to fill production tubing 24 up to float valve 80. As the oil accumulates in float valve 80, the ball 82 will come to rest against seat 84, thereby preventing a further venting through vent/pressure line 28, three-way valve 170 and choke 188 to atmosphere. Once the ball 82 comes to rest against the seat 84, the small remaining pressure in vent-pressure line 28 and conduit 186 will be vented through choke 188 to atmosphere, thereby causing pressure switch 196 to close. Pressure switch 196 is set to close when the small amount of pressure contained in conduit 186 is lost, which occurs when float valve 80 closes, thereby indicating the accumulator 124 is full of oil.

Upon the closing of the pressure switch 196 and pressure switch 202, as was previously closed when casing 12 was pressurized to fill storage tank 26, power is fed through the clock 198 and timer 200 to energize the three-way valve 170. Upon energization of the three-way valve 170 the core 174 inside of winding 172 moves downward thereby raising lever 176 to seat ball 182 against seat 184 and unseat ball 178 from seat 180. Now the vent/pressure line 28 is connected to the pressure tank 26. The pressure from pressure tank 26 flows directly through conduit 192 and branch conduit 194, through the three-way valve 170 into the vent/pressure line 28. The pressurized air pushes against the oil inside of float valve 80 and forces it back down through crossover 92 into accumulator 124. At the same time the oil in accumulator 124 is being forced up through check valve 126 and into stinger tube 112. From the stinger tube 112 the oil is being forced upward through chamber 98, bypass tubing 104 and back into production tubing 20 at a location above plunger 32. The pressurized air through vent/pressure line 28 continues to force the oil up through the stinger tube 112 in the manner just previously described until the timer 200 has expired, thereby changing the position of three-way valve 170.

As previously described, any pressure inside of pressure tank 26 is felt immediately below differential pressure valve 46 by means of cross bore 64 and holes 66. The plunger 32, which may be the McMurray type, allows the oil contained in production tubing 20 to flow through the plunger 32 at a very slow rate. Therefore, the weight of the column of oil generates a pressure which will be reflected below plunger 32 through chamber 50 and hole 52 to bellows 48 of differential valve 46. Once the weight of the column of oil above plunger 32 reaches a predetermined amount so that a given pressure differential exists across differential pressure valve 46, the valve 46 will be open for any pressure differential below that predetermined pressure differential. Upon opening the pressure differential valve 46, pressurized air inside of casing 12 will force the plunger 32 and the column of oil to the surface of the oil well 10. The valves inside of plunger 32 close when hit by a large amount of pressurized air, thereby forcing the plunger 32 and the column of oil to the well head without the oil flowing down through the plunger 32. At the surface of the oil well 10 the oil immediately above the plunger 32 will flow through check valve 168 and tubing 166 into the oil storage tank. The plunger 32, however, will continue beyond tubing 66 of the upper production casing 154 to hit pneumatic bellows 156 thereby opening sliding valve 160. The sliding valve 160 would then vent any air below the plunger 32 to a separator through tubing 162. The plunger 32 will be held into position against the pneumatic bellows 156 until essentially all the pressurized air has been removed from production tubing 20.

It is important that the timer 200 be set so that just enough time will be allowed to raise the column of oil and the plunger to the well head upon deenergizing the three-way valve 170. Once the three-way valve 170 is deenergized, it will return to the position shown in FIG. 1*a* thereby terminating the connection between the vent/pressure line 28 and storage tank 26, and reestablishing the communication between vent/pressure line 28 and atmosphere. After the pressure in production tubing 20 has been relieved, the plunger 32 will fall back to its position shown in FIG. 1*b* and the cycle will begin to repeat itself by oil collecting in the accumulator 124.

ALTERNATIVE EMBODIMENT

Referring now to FIG. 2 of the drawings, there is shown an alternative embodiment of the present invention with the control portion not being shown in detail because it is substantially identical to the controls shown and described in conjunction with FIG. 1*a*. Numbers that were used in conjunction with the previous description of FIGS. 1*a* and 1*b* will be used in FIG. 2 where appropriate. Again the oil well 10 has casing 12 that is located in the earth formation 14 and held in place by means of cement 16 and extends all the way to the oil producing zone 18. Inside of the casing 12 is located production tubing 20 with the area between the production tubing 20 and the casing 12, and above packer 24, being pressure storage tank 26. Again the top of the oil well 12 is sealed by means of a plate 22 so that only the production tubing 20 extends therethrough. Internal to the production tubing 20 is located vent/pressure line 28 that was contained on the outside thereof in FIGS. 1*a* and 1*b*. The vent/pressure line again connects to three-way valve 170 in the manner previously described in conjunction with FIGS. 1*a* and 1*b*.

The vent/pressure line 28 extends down through the production tubing 20 to the float valve 80 which has a ball float 82 contained inside of housing 204 and a seat 84 contained at the top thereof. The lower portion of the housing 204 is connected to a crossover line 92 by means of a flange seat 96 having slots 94 cut therein so that chamber 86 will be in continual communication with crossover line 92. Immediately below chamber 86 is a chamber 98 having slots 100 cut therein to allow communication with annulus 102. From annulus 102 there is direct communication with the annular space between production tubing 20 and the vent/pressure line 28.

The crossover line 92 extends through hold downs 116 and 118 that rest against seating nipples of the production tubing 20. Also, chamber 98 communicates through the hold downs 116 and 118 via tubing 114. Immediately below the crossover portion 120 is located the packer 24. The packer 24 should be located at or near the top of the oil producing zone 18. Immediately below the packer 24 is a standing valve 206 that is represented pictorially by ball 208 and seat 210. The standing valve 206 allows communication from the oil producing zone 18, annulus 212 into the production tubing 20. Near the bottom of the oil producing zone 18 is located another packer 214 that seals off the lower portion 216 of the oil well 10. The lower portion 216 can now serve as the accumulator that was previously described in conjunction with FIG. *b*. Though the production tubing 20 will probably extend to the bottom of the lower portion 216 it contains perforations 218 to allow free flow of oil through the production tubing 20. The casing 12 will extend to the bottom of the oil well 10.

Also extending from the crossover portion 20 and through packers 24 and 214 is stinger tube 112. The stinger tube extends to substantially the bottom of the accumulator formed by the lower portion 216 and has a check valve 126 located therein that is represented pictorially by ball 128 and seat 130.

METHOD OF OPERATION OF THE ALTERNATIVE EMBODIMENT

In the alternative embodiment again the casing 12 is pressurized to provide pressure in the pressure storage tank 26 formed by the upper portion of the casing 12. Again the accumulator represented by lower portion 216 is vented to atmosphere via vent/pressure line 28 and crossover line 92 in a manner previously described in conjunction with FIGS. 1*a* and 1*b*. Oil from the oil producing zone 18 flows through the perforations 122 into annulus 212. From annulus 212 the oil flows through standing valve 206 into production tubing 20 and down into the accumulator formed by the lower portion 216 of the casing 12. Once the lower portion 216 is filled with oil, the oil will begin to fill production tubing 20 until it reaches float valve 80 located immediately above packer 24. The ball float 82 will float on top of the surface of oil and come to rest against seat 84, thereby terminating the venting through vent/pressure line 28. In a manner previously described in conjunction with FIGS. 1*a* and 1*b*, the three-way valve 70 will now be energized thereby unseating ball valve 178 and seating ball valve 182. Pressure from the pressure tank 26 now flows through the vent/pressure line 80 to force the oil back down through crossover line 92, production tubing 20 and up through stinger 112. In this case the timer is set so that enough time is allowed to force essentially all of the oil contained in lower portion 216 up into stinger tube 112. Thereafter the three-way valve 170 is deenergized and the pressure contained in the lower portion 216 is vented through vent/pressure line 28 and oil is again allowed to accumulate from oil producing zone 18. Notice that check valve 206 does not allow the pressurized air to be felt against the oil producing zone 18. Once enough oil has again accumulated in the lower portion 216 and production tubing 20 to shut the float valve 80 the cycle will be repeated. Again the oil will be forced up through the stinger tube 112 in the manner previously described for the earlier cycle. This process is repeated again and again until the column of oil in the production tubing 20 will reach the surface of the oil well 10. Thereafter, for each cycle of operation, oil will flow through tubing 166 to the oil storage tank. Once oil has been received in the stinger tube 112, it cannot flow back into the lower portion 216 because of check valve 126.

As the oil well 10 is brought into production, the cycle of the timer may have to be adjusted due to the increased weight of the oil column contained in production tubing 20. As the weight of the column of oil increases additional time will be necessary to insure that essentially all of the oil contained in the lower portion 216 has been forced into the stinger tube 112.

What is claimed is:

1. An artificial lift apparatus for a hydrocarbon producing well having a well head and a well casing therein, said apparatus comprising:

production tubing extending from the well head into the casing to a level below which the hydrocarbon will naturally fill from a hydrocarbon producing zone through perforations in the casing;

accumulator means attached to the bottom of the production tubing for collecting hydrocarbon in the well;

gas tubing means extending from the well head into the accumulator means for communication therewith from the well head;

piston means located in said production tubing and normally positioned above said accumulator means, said piston means being free to move up and down said production tubing;

path means communicating with said accumulator for moving hydrocarbon above said piston means when said piston means is in its normal position;

first check valve means for only allowing flow of hydrocarbon into said accumulator means;

control means for alternately venting and pressurizing said accumulator means via said gas tubing means, hydrocarbon being allowed to collect in said accumulator means via said first check valve means during venting, thereafter, in response to said pressurizing, said hydrocarbon is moved through said path means above said piston means in said production tubing and raised to the well head with said piston means;

sealing means for sealing the top of said casing;

packer means for sealing said casing above said perforations in said casing to form a tank means from the upper portion of said casing means pressurizing said tank with gas;

said pressurized gas means being used to pressurize said accumulator means fluidly communicating said tank with the lower face of said piston means so that said piston means moves up and down in response to pressure within said tank.

2. The artificial lift apparatus as recited in claim 1 further includes a crossover means connected to said gas tubing means and said path means below said crossover means said path means being in said tubing means.

3. The artificial lift apparatus as recited in claim 2 wherein said means communicating said tank with the lower face of said piston includes a differential valve means that operates off a pressure differential between a column of oil in said production tubing and the pressure of said pressurized gas in said tank means, said differential valve means raises said piston means by providing said lift pressure.

4. The artificial lift apparatus as recited in claim 3 wherein pressure from said tank means is communicated to one side of said differential valve means via perforations in said production tubing.

5. The artificial lift apparatus as recited in claim 3 further includes a valve means at the well head to vent said production tubing to a separator means after said piston means is raised to the well head.

6. The artificial lift apparatus as recited in claim 5 includes a pop-off valve means to directly connect said gas tubing to atmosphere after each cycle to rapidly reduce pressure in said accumulator means.

* * * * *